US009140439B2

(12) United States Patent
Yang

(10) Patent No.: US 9,140,439 B2
(45) Date of Patent: Sep. 22, 2015

(54) CUP-SHAPED HEAT DISSIPATER HAVING FLOW GUIDE HOLE ANNULARLY ARRANGED AT THE BOTTOM PERIPHERY AND APPLIED IN ELECTRIC LUMINOUS BODY

(76) Inventor: Tai-Her Yang, Dzan-Hwa (TW)

( * ) Notice: Subject to any disclaimer, the term of this patent is extended or adjusted under 35 U.S.C. 154(b) by 175 days.

(21) Appl. No.: 13/554,092

(22) Filed: Jul. 20, 2012

(65) Prior Publication Data

US 2014/0022799 A1 Jan. 23, 2014

(51) Int. Cl.

| | |
|---|---|
| ***F21V 29/00*** | (2015.01) |
| ***F21V 29/75*** | (2015.01) |
| ***F21V 29/83*** | (2015.01) |
| *F21Y 101/02* | (2006.01) |
| *F21V 29/76* | (2015.01) |
| *F21V 29/80* | (2015.01) |
| *F21V 29/85* | (2015.01) |
| *F21V 29/89* | (2015.01) |

(52) U.S. Cl.

CPC ..... *F21V 29/004* (2013.01); *F21V 29/75* (2015.01); *F21V 29/83* (2015.01); *F21V 29/763* (2015.01); *F21V 29/80* (2015.01); *F21V 29/86* (2015.01); *F21V 29/89* (2015.01); *F21Y 2101/02* (2013.01)

(58) Field of Classification Search

CPC ... F21V 29/004; F21V 29/2262; F21V 29/75; F21V 29/763; F21V 29/80; F21V 29/81; F21V 29/83

USPC ..... 362/373, 294, 249.02, 800

See application file for complete search history.

(56) References Cited

U.S. PATENT DOCUMENTS

2011/0080726 A1* 4/2011 Zhang et al. ..... 362/235

* cited by examiner

*Primary Examiner* — Jason Moon Han

(74) *Attorney, Agent, or Firm* — Bacon & Thomas, PLLC

(57) ABSTRACT

The present invention provides a novel cup-shaped heat dissipater (100) having the outer cup bottom of the cup-shaped heat dissipater formed as a planar or convex or concave surface for accommodating the electric luminous body (200), so the heat can be dissipated to the exterior from the surface of the heat dissipater (100), and with the enlarged heat dissipation surface formed in the cup-shaped inner recessed structure of the heat dissipater (100) opposite to the installation location of the electric luminous body (200), the heat can also be directly dissipated through the larger heat dissipation area, furthermore, flow guide holes allowing airflow to pass are formed on the heat dissipater (100) for performing heat dissipating convection through the heat dissipating fluid.

18 Claims, 4 Drawing Sheets

CUP-SHAPED HEAT DISSIPATER HAVING FLOW GUIDE HOLE ANNULARLY ARRANGED AT THE BOTTOM PERIPHERY AND APPLIED IN ELECTRIC LUMINOUS BODY

BACKGROUND OF THE INVENTION (a) Field of the Invention

The present invention provides a novel cup-shaped heat dissipater having flow guide hole for meeting the heat dissipation requirement of an electric luminous body, e.g. the heat dissipation requirement of a light emitting diode (LED) which is adopted as the electric luminous body (200); the outer cup bottom of the cup-shaped heat dissipater (100) is formed as a planar or convex or concave surface for accommodating the electric luminous body (200), so the heat generated by the electric luminous body (200) can be dissipated to the exterior from the surface of the heat dissipater (100), with the enlarged heat dissipation surface formed in the cup-shaped inner recessed structure of the heat dissipater (100) opposite to the installation location of the electric luminous body (200), the heat can also be directly dissipated through the larger heat dissipation area, furthermore, flow guide holes allowing airflow to pass are formed on the heat dissipater (100) for performing heat dissipating convection through the heat dissipating fluid.

(b) Description of the Prior Art

A conventional heat dissipation device applied in the electric luminous body (200) of an electric illumination device, e.g. the heat dissipater used in a LED illumination device, usually transmits the heat generated by the LED to the heat dissipater then dissipates the heat to the exterior through the surface of the heat dissipater, thereby the heat dissipation area is limited.

SUMMARY OF THE INVENTION

A conventional heat dissipation device applicable in the electric luminous body (200) of an electric illumination device, e.g. the heat dissipater used in a LED illumination device, usually transmits the heat generated by the LED to the heat dissipater then dissipates the heat to the exterior through the surface of the heat dissipater, thereby limiting the heat dissipation area; the present invention provides a novel cup-shaped heat dissipater having flow guide hole for meeting the heat dissipation requirement of an electric luminous body, e.g. the heat dissipation requirement of a light emitting diode (LED) which is adopted as the electric luminous body (200); the outer cup bottom of the cup-shaped heat dissipater (100) is formed as a planar or convex or concave surface for accommodating the electric luminous body (200), so the heat generated by the electric luminous body (200) can be dissipated to the exterior from the surface of the heat dissipater (100), and further with the enlarged heat dissipation surface formed in the cup-shaped inner recessed structure of the heat dissipater (100) opposite to the installation location of the electric luminous body (200), the heat can also be directly dissipated through the larger heat dissipation area, furthermore, flow guide holes allowing airflow to pass are formed on the heat dissipater (100), the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

DESCRIPTION OF MAIN COMPONENT SYMBOLS

Figure 1:
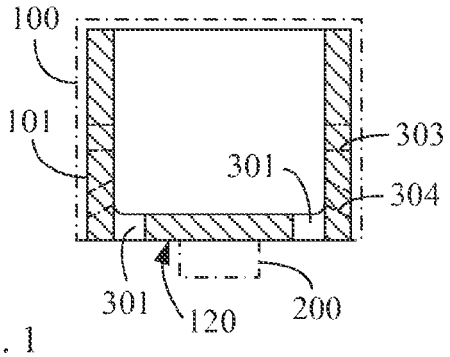
FIG. 1 is a cross sectional view showing the basic structure of the heat dissipater (100), according to the present invention.

100: Heat dissipater
101: Annular surface of heat dissipater
103: Central column
105: Tooth notch
106: Fork-shaped annular structure
107: Multiple-plate type heat dissipation structure
108: Multiple-column type heat dissipation structure
109: Protection net
110: Top cover
111: Support column
112: Ventilation port
120: Cup bottom surface
200: Electric luminous body
301: Flow guide hole annularly arranged at the bottom periphery
303: Radial flow guide hole
304: Inclined flow guide hole at bottom corner

DETAILED DESCRIPTION OF THE PREFERRED EMBODIMENTS

A conventional heat dissipation device applied in the electric luminous body (200) of an electric illumination device, e.g. the heat dissipater used in a LED illumination device, usually transmits the heat generated by the LED to the heat dissipater then dissipates the heat to the exterior through the surface of the heat dissipater, thereby the heat dissipation area is limited.

The present invention provides a novel cup-shaped heat dissipater having flow guide hole for meeting the heat dissipation requirement of an electric luminous body, e.g. the heat dissipation requirement of a light emitting diode (LED) which is adopted as the electric luminous body (200); the outer cup bottom of the cup-shaped heat dissipater (100) is formed as a planar or convex or concave surface for accommodating the electric luminous body (200), so the heat generated by the electric luminous body (200) can be dissipated to the exterior from the surface of the heat dissipater (100), and further with the enlarged heat dissipation surface formed in the cup-shaped inner recessed structure of the heat dissipater (100) opposite to the installation location of the electric luminous body (200), the heat can also be directly dissipated through the larger heat dissipation area, furthermore, flow guide holes allowing airflow to pass are formed on the heat dissipater (100), the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 2:
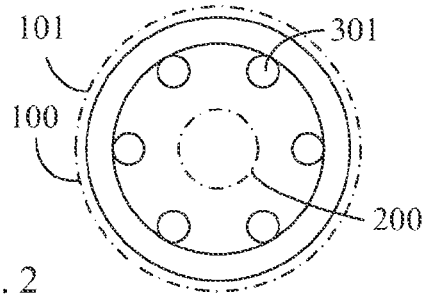
FIG. 2 is a top view of FIG. 1.

FIG. 1 is a cross sectional view showing the basic structure of the heat dissipater (100), according to the present invention;

FIG. 2 is a top view of FIG. 1;

As shown in FIG. 1 and FIG. 2, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours; the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be dissipated to the exterior from the surface of the heat dissipater, and further with the enlarged heat dissipation surface formed in the cup-shaped inner recessed structure opposite to the installation location of the electric luminous body (200), the heat can also be directly dissipated through the larger heat dissipation area, furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes at the center of the cup bottom surface (120); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 3:
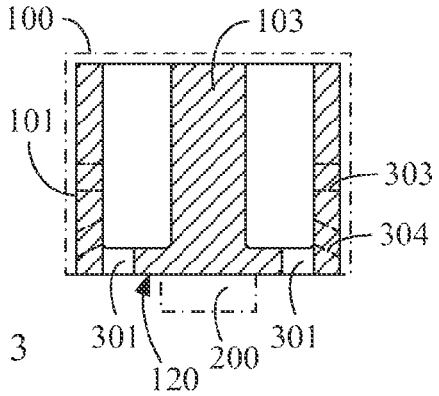
FIG. 3 is a cross sectional view illustrating the cup-shaped structure formed in the heat dissipater (100) opposite to the installation location of the electric luminous body (200) being formed with a single annular cup-shaped inner recessed structure, according to the present invention.
Figure 4:
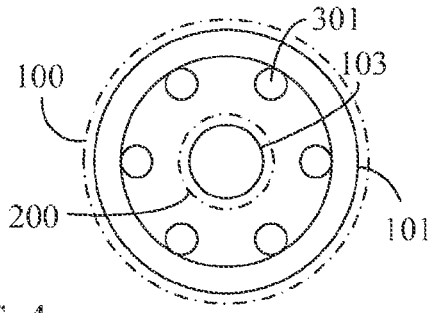
FIG. 4 is a top view of FIG. 3.
Figure 23:
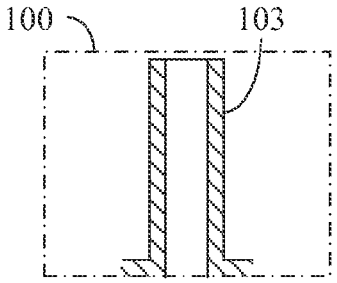
FIG. 23 is a schematic structural view illustrating the central column (103) being composed as a tubular central column, according to the present invention.

FIG. 3 is a cross sectional view illustrating the cup-shaped structure formed in the heat dissipater (100) opposite to the installation location of the electric luminous body (200) being formed with a single annular cup-shaped inner recessed structure, according to the present invention;

FIG. 4 is a top view of FIG. 3;

As shown in FIG. 3 and FIG. 4, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours; wherein one surface of the heat dissipater (100) is installed with the electric luminous body (200), and the other surface of the heat dissipater (100) is formed with the single cup-shaped inner recessed structure and a central column (103); the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the single cup-shaped inner recessed structure formed on the other surface of the heat dissipater (100), the solid central column (103) (as shown in FIG. 3 is one embodiment formed in a solid state) or a tubular central column (103) (as shown in FIG. 23) and the annular surface of heat dissipater (101) of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 5:
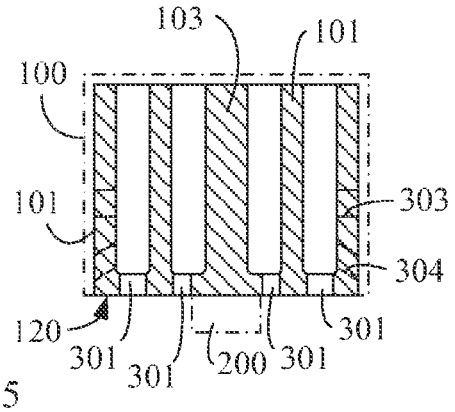
FIG. 5 is a cross sectional view illustrating the cup-shaped structure formed in the heat dissipater (100) opposite to the installation location of the electric luminous body (200) being formed with a multiple annular cup-shaped inner recessed structure, according to the present invention.
Figure 6:
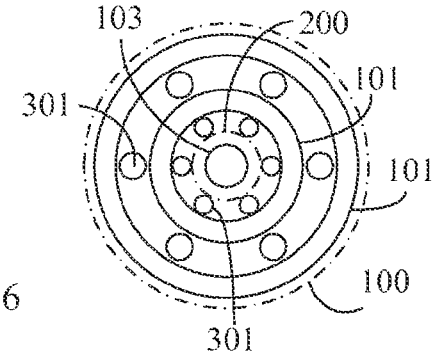
FIG. 6 is a top view of FIG. 5.

FIG. 5 is a cross sectional view illustrating the cup-shaped structure formed in the heat dissipater (100) opposite to the installation location of the electric luminous body (200) being formed with a multiple annular cup-shaped inner recessed structure, according to the present invention;

FIG. 6 is a top view of FIG. 5;

As shown in FIG. 5 and FIG. 6, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours; wherein one surface of the heat dissipater (100) is installed with the electric luminous body (200), the other surface of the heat dissipater (100) is formed with two or more cup-shaped inner recessed structures and the central column (103) and two or more layers of annular surfaces of heat dissipater (101); the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the two or more cup-shaped inner recessed structures formed on the other surface of the heat dissipater (100), the solid central column (103) (as shown in FIG. 5 is one embodiment formed in a solid state) or a tubular central column (103) (as shown in FIG. 23) and two or more layers of annular surfaces of heat dissipater (101), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 7:
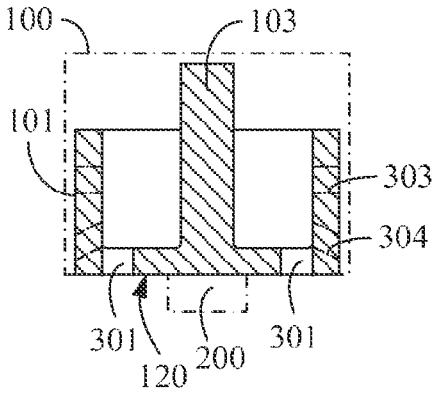
FIG. 7 is a cross sectional view of the first embodiment of the present invention illustrating the cup-shaped structure formed in the heat dissipater (100) opposite to the installation location of the electric luminous body (200) being formed with a single annular cup-shaped inner recessed structure and a stepped structure having the higher central column (103) and the lower outer periphery.
Figure 8:
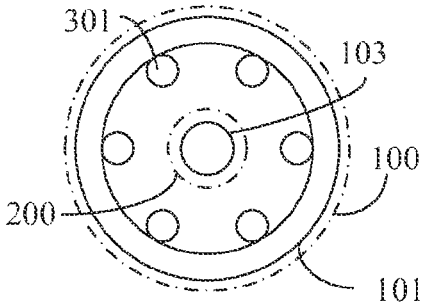
FIG. 8 is a top view of FIG. 7.

FIG. 7 is a cross sectional view of the first embodiment of the present invention illustrating the cup-shaped structure formed in the heat dissipater (100) opposite to the installation location of the electric luminous body (200) being formed with a single annular cup-shaped inner recessed structure and a stepped structure having the higher central column (103) and the lower outer periphery;

FIG. 8 is a top view of FIG. 7;

As shown in FIG. 7 and FIG. 8, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), the other surface of the heat dissipater (100) is formed with the single cup-shaped inner recessed structure and a higher central column (103), thereby forming a stepped structure having the higher central column (103) and the lower outer periphery; the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the single cup-shaped inner recessed structure formed on the other surface of the heat dissipater (100) and the higher solid central column (103) (as shown in FIG. 7 is one embodiment formed in a solid state) or a tubular central column (103) (as shown in FIG. 23), thereby forming a stepped structure having the higher central column (103) and the lower outer periphery and the annular surface of heat dissipater (101) of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 9:
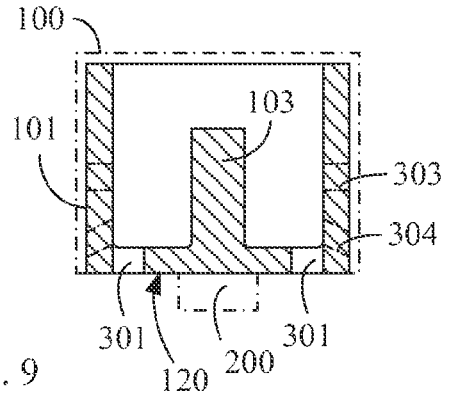
FIG. 9 is another cross sectional view of the second embodiment of the present invention illustrating the cup-shaped structure formed in the heat dissipater (100) opposite to the installation location of the electric luminous body (200) being formed with a single annular cup-shaped inner recessed structure and a stepped structure having the lower central column (103) and the higher outer periphery.
Figure 10:
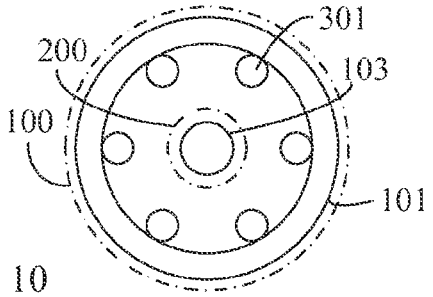
FIG. 10 is a top view of FIG. 9.

FIG. 9 is another cross sectional view of the second embodiment of the present invention illustrating the cup-shaped structure formed in the heat dissipater (100) opposite to the installation location of the electric luminous body (200) being formed with a single annular cup-shaped inner recessed structure and a stepped structure having the lower central column (103) and the higher outer periphery;

FIG. 10 is a top view of FIG. 9;

As shown in FIG. 9 and FIG. 10, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), the other surface of the heat dissipater (100) is formed with the single cup-shaped inner recessed structure and a lower central column (103), thereby forming a stepped structure having the lower central column (103) and the higher outer periphery; the surface of one or both of the cup periphery and/or the inner annular surface of the heat dissipater (100) is formed as a planar or wavelike structure or one or both of the inner periphery and the outer periphery is formed with a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the single cup-shaped inner recessed structure formed on the other surface of the heat dissipater (100) and the lower solid central column (103) (as shown in FIG. 9 is one embodiment formed in a solid state) or a tubular central column (103) (as shown in FIG. 23), thereby forming a stepped structure having the lower central column (103) and the higher outer periphery and the annular surface of heat dissipater (101), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 11:
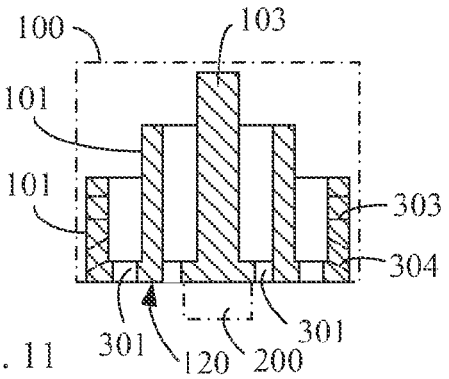
FIG. 11 is one another cross sectional view of the third embodiment of the present invention illustrating the cup-shaped structure formed in the heat dissipater (100) opposite to the installation location of the electric luminous body (200) being formed with a multiple annular cup-shaped inner recessed structure and a multiple stepped structure having the higher central column (103) and the lower multiple annular outer periphery.
Figure 12:
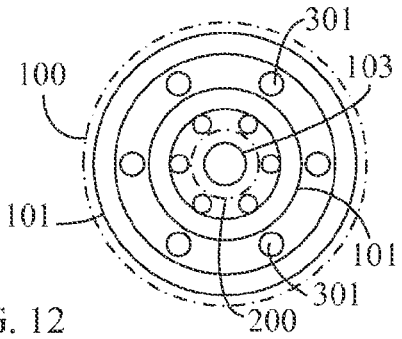
FIG. 12 is a top view of FIG. 11.

FIG. 11 is one another cross sectional view of the third embodiment of the present invention illustrating the cup-shaped structure formed in the heat dissipater (100) opposite to the installation location of the electric luminous body (200) being formed with a multiple annular cup-shaped inner recessed structure and a multiple stepped structure having the higher central column (103) and the lower multiple annular outer periphery;

FIG. 12 is a top view of FIG. 11;

As shown in FIG. 11 and FIG. 12, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), the other surface of the heat dissipater (100) is formed with two or more multiple annular cup-shaped inner recessed structures and a central column (103) and two or more layers of annular surfaces of heat dissipater (101), thereby forming a multiple stepped structure having the higher central column (103) and the lower multiple annular outer periphery; the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by two or more cup-shaped inner recessed structures formed on the other surface of the heat dissipater (100) and the solid central column (103) (as shown in FIG. 11 is one embodiment formed in a solid state) or a tubular central column (103) (as shown in FIG. 23), and two or more layers of annular surfaces of heat dissipater (101), thereby forming a multiple stepped structure having the higher central column (103) and the lower multiple annular outer periphery, furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120);

the mentioned heat dissipater (100) further includes that the cup-shaped structure formed in the heat dissipater (100) opposite to the installation location of the electric luminous body (200) has two or more cup-shaped inner recessed structures and a central column (103) and two or more layers of annular surfaces of heat dissipater (101), thereby forming a multiple-stepped structure having the higher outer periphery.

Figure 13:
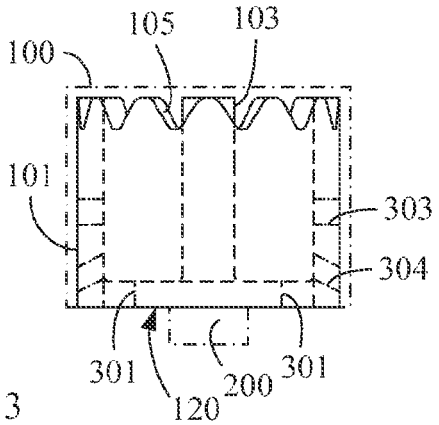
FIG. 13 is a schematic lateral view of the first embodiment of the present invention illustrating the upper periphery of the cup-shaped structure formed in the heat dissipater (100) opposite to the installation location of the electric luminous body (200) being formed with a crown-like tooth notch (105) and formed with a central column (103).
Figure 14:
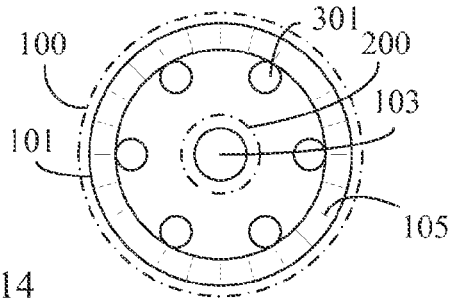
FIG. 14 is a top view of FIG. 13.

FIG. 13 is a schematic lateral view of the first embodiment of the present invention illustrating the upper periphery of the cup-shaped structure formed in the heat dissipater (100) opposite to the installation location of the electric luminous body (200) being formed with a crown-like tooth notch (105) and formed with a central column (103);

FIG. 14 is a top view of FIG. 13;

As shown in FIG. 13 and FIG. 14, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), the other surface of the heat dissipater (100) is formed the cup-shaped inner recessed structure having an annular structure formed with crown-like tooth notch (105) at the upper periphery and a central column (103), thereby forming a structure of the central column (103) and the annular structure formed with the crown-like tooth notch (105) at the periphery being at the same or different height; the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the cup-shaped inner recessed structure having the annular structure formed with the crown-like tooth notch (105) at the upper periphery formed on the other surface of the heat dissipater (100), the solid central column (103) (as shown in FIG. 3 is one embodiment formed in a solid state shown) or a tubular central column (103) (as shown in FIG. 23), and the annular surface of heat dissipater (101) of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 15:
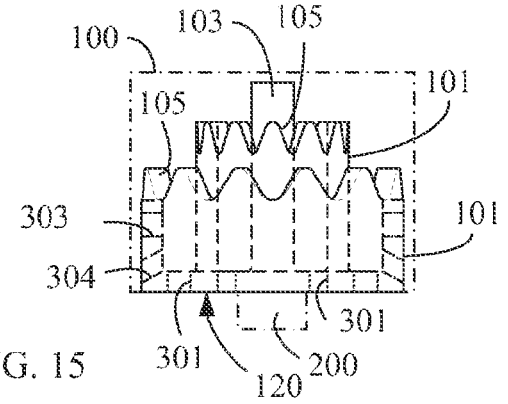
FIG. 15 is another schematic lateral view of the second embodiment of the present invention illustrating the upper periphery of the cup-shaped structure formed in the heat dissipation member (100) opposite to the installation location of the electric-powered light emitting unit (200) being formed with multiple crown-like tooth notch (105) and a structure having the higher central column (103) and the lower outer periphery.
Figure 16:
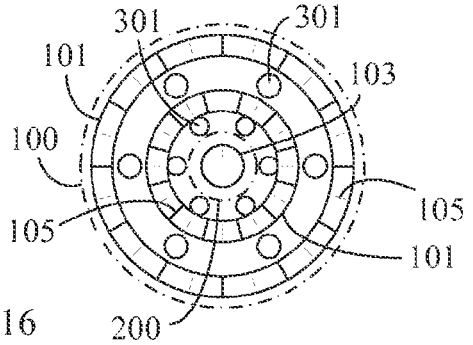
FIG. 16 is a top view of FIG. 15.

FIG. 15 is another schematic lateral view of the second embodiment of the present invention illustrating the upper periphery of the cup-shaped structure formed in the heat dissipation member (100) opposite to the installation location of the electric-powered light emitting unit (200) being formed with multiple crown-like tooth notch (105) and a structure having the higher central column (103) and the lower outer periphery;

FIG. 16 is a top view of FIG. 15;

As shown in FIG. 15 and FIG. 16, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), the other surface of the heat dissipater (100) is formed with the cup-shaped inner recessed structure having the multiple crown-like tooth notch (105) at the upper periphery and a central column (103), thereby forming a multiple annular structure having the higher central column (103) and having the lower crown-like tooth notch (105) at the outer periphery; the surface of one or both of the cup periphery and/or the inner annular surface of the heat dissipater (100) is formed as a planar or wavelike structure or one or both of the inner periphery and the outer periphery is formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the cup-shaped inner recessed structure having the multiple annular structure formed with crown-like tooth notch (105) at the upper periphery formed at the other surface of the heat dissipater (100) and the solid central column (103) (as shown in FIG. 15 is one embodiment formed in a solid state) or a tubular central column (103) (as shown in FIG. 23) thereby forming a multiple annular structure having the higher central column (103) and having the lower crown-like tooth notch (105) at the outer periphery, and the annular surface of heat dissipater (101) of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120);

the mentioned heat dissipater (100) further includes that the upper periphery of the cup-shaped structure formed in the heat dissipater (100) opposite to the installation location of the electric luminous body (200) has multiple crown-like tooth notches (105) and a central column (103), thereby forming a structure having the lower central column (103) and the higher multiple annular structure having the crown-like tooth notches (105) at the outer periphery;

the multiple annular structure of the mentioned multiple crown-like tooth notches (105) is defined as two or more layers.

Figure 17:
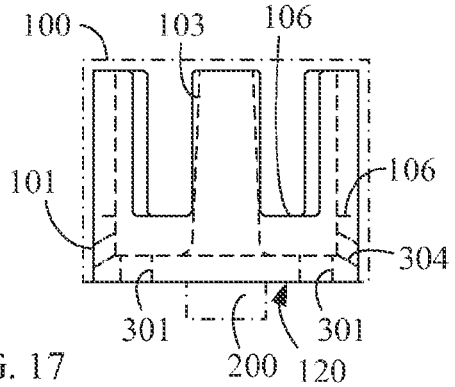
FIG. 17 is a schematic view illustrating the heat dissipater (100) opposite to the installation location of the electric luminous body (200) being installed with a conical column member and the cup-shaped structure being formed as a fork-shaped annular structure, according to the present invention.
Figure 18:
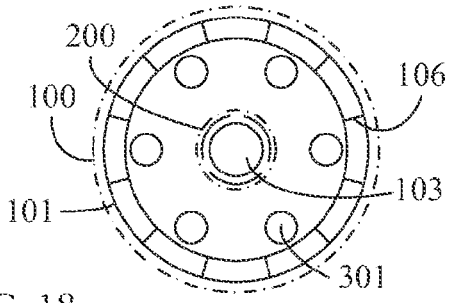
FIG. 18 is a top view of FIG. 17.

FIG. 17 is a schematic view illustrating the heat dissipater (100) opposite to the installation location of the electric luminous body (200) being installed with a conical column member and the cup-shaped structure being formed as a fork-shaped annular structure, according to the present invention;

FIG. 18 is a top view of FIG. 17;

As shown in FIG. 17 and FIG. 18, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), the other surface of the heat dissipater (100) is formed with the cup-shaped inner recessed structure having the fork-shaped annular structure (106) and the conical central column (103); the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the cup-shaped inner recessed structure being formed as the fork-shaped annular structure (106) and installed with the conical solid central column (103) (as shown in FIG. 17 is one embodiment formed in a solid state) or a tubular central column (103) (as shown in FIG. 23) and the annular surface of heat dissipater (101) of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes, which axially penetrate the central column (103), at the center of the cup bottom surface (120) (as shown in FIG. 23); (c) installing one or more inclined flow guide holes at bottom corner (304) at the annular corner formed between the annular heat dissipater bottom of the heat dissipater (100) and the cup bottom surface (120).

Figure 19:
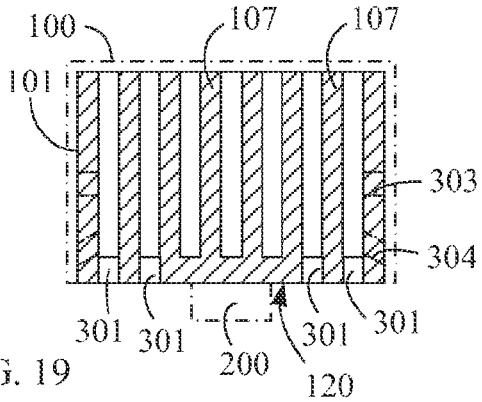
FIG. 19 is a cross sectional view illustrating the interior of the cup-shaped structure formed in the heat dissipater (100) opposite to the installation location of the electric luminous body (200) being installed with a multiple-plate type heat dissipation structure (107), according to the present invention.
Figure 20:
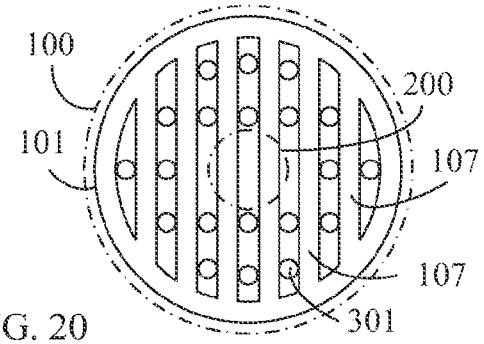
FIG. 20 is a top view of FIG. 19.

FIG. 19 is a cross sectional view illustrating the interior of the cup-shaped structure formed in the heat dissipater (100) opposite to the installation location of the electric luminous body (200) being installed with a multiple-plate type heat dissipation structure (107), according to the present invention;

FIG. 20 is a top view of FIG. 19;

As shown in FIG. 19 and FIG. 20, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), the other surface of the heat dissipater (100) is formed with the cup-shaped inner recessed structure having the multiple-plate type heat dissipation structure (107) therein; the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the cup-shaped inner recessed structure at the other surface of the heat dissipater (100) having the multiple-plate type heat dissipation structure (107) therein and the annular surface of heat dissipater (101) of heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 21:
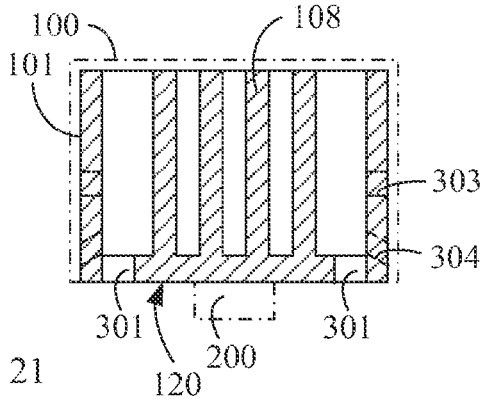
FIG. 21 is a cross sectional view illustrating the interior of the cup-shaped structure formed in the heat dissipater (100) opposite to the installation location of the electric luminous body (200) being installed with a multiple-column type heat dissipation structure (108), according to one embodiment of the present invention.
Figure 22:
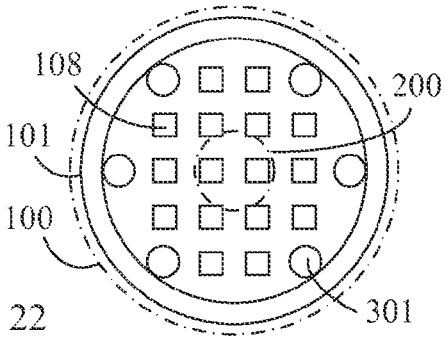
FIG. 22 is a top view of FIG. 21.

FIG. 21 is a cross sectional view illustrating the interior of the cup-shaped structure formed in the heat dissipater (100) opposite to the installation location of the electric luminous body (200) being installed with a multiple-column type heat dissipation structure (108), according to one embodiment of the present invention;

FIG. 22 is a top view of FIG. 21;

As shown in FIG. 21 and FIG. 22, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), and the other surface of the heat dissipater (100) is formed with the cup-shaped inner recessed structure having the multiple-column type heat dissipation structure (108) therein; the surface of one or both of the cup periphery and/or the inner annular surface of the heat dissipater (100) is formed as a planar or wavelike structure or formed as a structure having heat dissipation fins;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the cup-shaped inner recessed structure at the other surface of the heat dissipater (100) having the multiple-column type heat dissipation structure (108) therein and the annular surface of heat dissipater (101) of heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes at the center of the cup bottom surface (120) (as shown in FIG. 23); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

According to the cup-shaped heat dissipater having flow guide hole annularly arranged at the bottom periphery and applied in electric luminous body, except being composed of a solid central column, the central column (103) can further be composed of a tubular central column;

FIG. 23 is a schematic structural view illustrating the central column (103) being composed as a tubular central column, according to the present invention;

As shown in FIG. 23, the central column (103) of the present invention is composed of the tubular central column.

Figure 24:
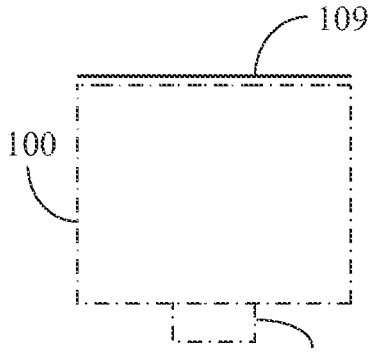
FIG. 24 is a schematic lateral view illustrating the top of the heat dissipater (100) opposite to the installation location of the electric luminous body (200) being additionally installed with a protection net (109), according to one embodiment of the present invention.

FIG. 24 is a schematic lateral view illustrating the top of the heat dissipater (100) opposite to the installation location of the electric luminous body (200) being additionally installed with a protection net (109), according to one embodiment of the present invention;

As shown in FIG. 24, according to one embodiment of the present invention, the top of the heat dissipater (100) opposite to the installation location of the electric luminous body (200) is additionally installed with the protection net (109).

Figure 25:
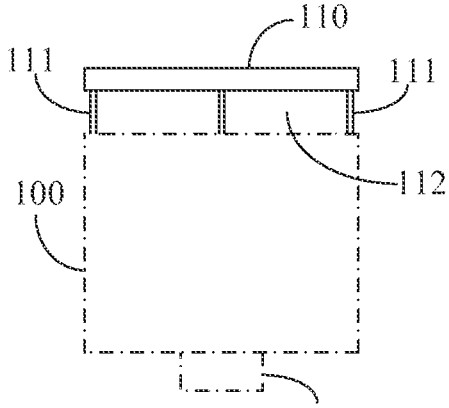
FIG. 25 is a schematic lateral view illustrating the top of the heat dissipater (100) opposite to the installation location of the electric luminous body (200) being installed with a top cover (110), and formed with a ventilation port (112) and a support column (111) served for combining and supporting between the top cover (110) and the heat dissipater (100), according to one embodiment of the present invention.

FIG. 25 is a schematic lateral view illustrating the top of the heat dissipater (100) opposite to the installation location of the electric luminous body (200) being installed with a top cover (110), and formed with a ventilation port (112) and a support column (111) served for combining and supporting between the top cover (110) and the heat dissipater (100), according to one embodiment of the present invention;

As shown in FIG. 25, according to one embodiment of the present invention, the top of the heat dissipater (100) opposite to the installation location of the electric luminous body (200) being installed with the top cover (110), and formed with the ventilation port (112) and the support column (111) served for combining and supporting between the top cover (110) and the heat dissipater (100).

Figure 26:
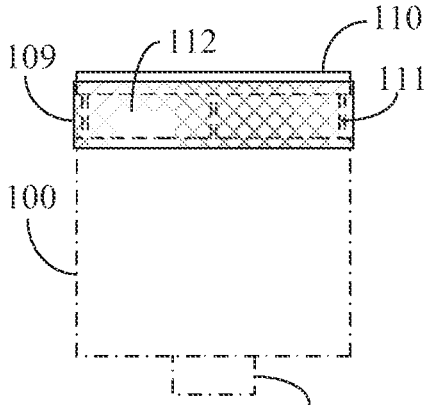
FIG. 26 is a schematic lateral view illustrating the support column (111) served for combining and supporting being installed between the top of the heat dissipater (100) opposite to the installation location of the electric luminous body (200) and the top cover (110), and the periphery of the ventilation port (112) being additionally installed with the protection net (109), according to one embodiment of the present invention.

FIG. 26 is a schematic lateral view illustrating the support column (111) served for combining and supporting being installed between the top of the heat dissipater (100) opposite to the installation location of the electric luminous body (200) and the top cover (110), and the periphery of the ventilation port (112) being additionally installed with the protection net (109), according to one embodiment of the present invention;

As shown in FIG. 26, according to one embodiment of the present invention, the support column (111) served for combining and supporting is installed between the top of the heat dissipater (100) opposite to the installation location of the electric luminous body (200) and the top cover (110), and the periphery of the ventilation port (112) is additionally installed with the protection net (109).

The mentioned electric luminous body (200) according to the cup-shaped heat dissipater having flow guide hole annularly arranged at the bottom periphery and applied in electric luminous body can further include being composed of the electric luminous body and optical component and lampshade.

The invention claimed is:

1. A cup-shaped heat dissipater (100) for an electric luminous body (200), comprising:

a thermally-conductive cup-shaped structure having an enlarged heat dissipation surface formed on an interior of the cup-shaped structure at a location opposite to an installation location of the electric luminous body (200), wherein:

the electric luminous body (200) is arranged on a bottom exterior surface (120) of the cup-shaped structure to project light in a direction away from said bottom exterior surface, heat generated by said electric luminous body (200) is dissipated by conduction of the heat through the cup-shaped structure to surfaces of the cup-shaped structure away from said bottom (120), the cup-shaped heat dissipater (100) has a stepped structure in which a central column (103) extends further from the bottom surface (120) than an upper annular surface of an upwardly-extending outer periphery (101), and the cup-shaped structure having at least one flow guide hole through which air flows upon the air being heated and consequently caused to rise by proximity the electric luminous body (200), the rising air dissipating heat through the cup-shaped structure as it rises, said at least one flow guide hole arranged in one of the following configurations:

(a) the at least one flow guide hole (301) includes flow guide holes (301) annularly arranged in a bottom of the cup-shaped structure;

(b) the at least one flow guide hole is located at a center of the bottom of the cup-shaped structure;

(c) the at least one flow guide hole includes at least one flow guide hole in said bottom of the cup-shaped structure and at least one flow guide hole (303) that extends radially through the side of the cup-shaped structure;

(d) the at least one flow guide hole includes at least one flow guide hole in the bottom of the cup-shaped structure having at least one inclined flow guide hole (304) that extends through a lower side adjacent the bottom of the cup-shaped structure.

2. A cup-shaped heat dissipater (100) as claimed in claim 1, wherein the at least one flow guide hole (301) includes flow guide holes (301) annularly arranged in a bottom of the cup-shaped structure.

3. A cup-shaped heat dissipater (100) as claimed in claim 1, wherein the at least one flow guide hole includes at least one flow guide hole (303) that extends radially through the side of the cup-shaped structure.

4. A cup-shaped heat dissipater (100) as claimed in claim 1, wherein the at least one flow guide hole includes at least one inclined flow guide hole (304) that extends through a lower side adjacent the bottom of the cup-shaped structure.

5. A cup-shaped heat dissipater (100) as claimed in claim 1, wherein the enlarged heat dissipation surface is a surface of a solid or tubular central column (103).

6. A cup-shaped heat dissipater (100) as claimed in claim 5, wherein the at least one flow guide hole axially penetrates the central column (103).

7. A cup-shaped heat dissipater (100) as claimed in claim 1, wherein the at least one flow guide hole axially penetrates the central column (103).

8. A cup-shaped heat dissipater (100) as claimed in claim 1, wherein the upper annular surface of the upwardly-extending outer periphery (101) is planar.

9. A cup-shaped heat dissipater (100) as claimed in claim 1, wherein the upper annular surface of the upwardly-extending outer periphery (101) includes notches (105) that form a wave-like surface.

10. A cup-shaped heat dissipater (100) as claimed in claim 1, wherein the cup-shaped heat dissipater (100) has a multiple stepped structure including said upwardly-extending outer periphery (101) and an upwardly-extending intermediate structure, in which the central column (103) extends further from the bottom surface (120) than a first upper annular surface of the upwardly-extending intermediate structure, and the first upper annular surface of the upwardly-extending intermediate structure extends further from the bottom surface (120) than a second upper annular surface of the upwardly-extending outer periphery (101).

11. A cup-shaped heat dissipater (100) as claimed in claim 10, wherein at least one of the first and second upper annular surfaces is planar.

12. A cup-shaped heat dissipater (100) as claimed in claim 10, wherein at least one of the first and second upper annular surfaces includes notches (105) that form a wave-like surface.

13. A cup-shaped heat dissipater (100) as claimed in claim 12, wherein both of the first and second upper annular surfaces includes notches (105) that form a wave-like surface.

14. A cup-shaped heat dissipater (100) as claimed in claim 1, wherein the cup-shaped heat dissipater (100) further includes a solid or tubular central column (103) having a height equal to a height of the upwardly-extending outer periphery (101).

15. A cup-shaped heat dissipater (100) as claimed in claim 1, wherein a surface of the heat dissipater (100) is formed with a cup-shaped inner recessed structure having a fork-shaped annular structure (106) and conical central column (103).

16. A cup-shaped heat dissipater (100) as claimed in claim 1, further comprising a protection net (109) installed at a location opposite to the electric luminous body.

17. A cup-shaped heat dissipater (100) as claimed in claim 1, further comprising a top cover (110) formed with a ventilation port (112), said top cover (110) being installed at a location opposite to the electric luminous body and supported by a support column (111).

18. A cup-shaped heat dissipater (100) as claimed in claim 1, further comprising a protection net (109) and top cover (110) installed at a location opposite to the electric luminous body, said top cover (110) being formed with a ventilation port (112) and supported by a support column (111).

* * * * *